US008844490B2

(12) United States Patent
Burrows et al.

(10) Patent No.: US 8,844,490 B2
(45) Date of Patent: Sep. 30, 2014

(54) CORONA IGNITER HAVING CONTROLLED LOCATION OF CORONA FORMATION

(75) Inventors: John Antony Burrows, Northwich (GB); James D. Lykowski, Temperance, MI (US); Alfred Permuy, Rueil-Malmaison (FR); Keith Hampton, Ann Arbor, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 240 days.

(21) Appl. No.: 13/350,456

(22) Filed: Jan. 13, 2012

(65) Prior Publication Data

US 2012/0279468 A1 Nov. 8, 2012

Related U.S. Application Data

(60) Provisional application No. 61/432,364, filed on Jan. 13, 2011, provisional application No. 61/432,520, filed on Jan. 13, 2011.

(51) Int. Cl.

| | |
|---|---|
| ***F02P 23/00*** | (2006.01) |
| ***H01T 13/34*** | (2006.01) |
| ***H01T 13/36*** | (2006.01) |
| ***H01T 19/00*** | (2006.01) |
| ***H01T 13/52*** | (2006.01) |
| ***H01T 13/50*** | (2006.01) |
| ***H01T 21/02*** | (2006.01) |

(52) U.S. Cl.

CPC ..... *H01T 13/50* (2013.01); *H01T 13/52* (2013.01); *H01T 21/02* (2013.01)

USPC ..... 123/143 B; 123/169 E; 123/606; 313/137; 313/145

(58) Field of Classification Search

CPC ..... F02P 9/007; H01T 13/34; H01T 13/36; H01T 19/00

USPC ..... 123/143 B, 169 E, 606; 313/137, 145

See application file for complete search history.

(56) References Cited

U.S. PATENT DOCUMENTS

| | | | |
|---|---|---|---|
| 2,030,937 | A | 2/1936 | Reichmann |
| 2,357,602 | A | 9/1944 | Peters et al. |

(Continued)

FOREIGN PATENT DOCUMENTS

| | | |
|---|---|---|
| EP | 1515594 A2 | 3/2005 |
| FR | 2859831 A1 | 3/2005 |

OTHER PUBLICATIONS

International Search Report mailed Mar. 14, 2012 (PCT/US2012/021302).

*Primary Examiner* — Erick Solis

(74) *Attorney, Agent, or Firm* — Robert L. Stearns; Dickinson Wright, PLLC

(57) ABSTRACT

A corona igniter 20 includes an insulator 28 surrounding a central electrode 24 and a shell 30 surrounding the insulator 28. The shell 30 presents a shell gap 38 having a shell gap width $w_s$ between a shell lower end 34 and a shell inner surface 90 or shell outer surface 92. The shell 30 has a shell thickness $t_s$ decreasing toward the shell lower end 34 allowing the shell gap width $w_s$ to increase toward the shell lower end 34. The shell gap 38 is open at the shell lower end 34 allowing air to flow therein, and the shell gap width $w_s$ is greatest at the shell lower end 34. The increasing shell gap width $w_s$ enhances corona discharge 22 along the insulator 28 between the central electrode 24 and shell 30.

20 Claims, 7 Drawing Sheets

(56) References Cited

U.S. PATENT DOCUMENTS

| | | | | |
|---|---|---|---|---|
| 2,470,568 | A | 5/1949 | McCrumm | |
| 3,743,877 | A | 7/1973 | Strumbos | |
| 4,963,784 | A | 10/1990 | Niessner | |
| 5,239,225 | A | 8/1993 | Moriya et al. | |
| 5,469,013 | A | 11/1995 | Kang | |
| 5,731,654 | A | 3/1998 | Benedikt et al. | |
| 5,831,377 | A | 11/1998 | Matsubara et al. | |
| 5,929,556 | A | 7/1999 | Matsubara et al. | |
| 6,215,233 | B1 | 4/2001 | Matsubara et al. | |
| 6,357,426 | B1 * | 3/2002 | Schleupen | 123/606 |
| 6,628,050 | B1 | 9/2003 | Kameda et al. | |
| 7,262,547 | B2 | 8/2007 | Klett et al. | |
| 7,723,906 | B2 | 5/2010 | Kadowaki et al. | |
| 7,816,846 | B2 | 10/2010 | Takada et al. | |
| 7,825,572 | B2 | 11/2010 | Nakayama et al. | |
| 2009/0031988 | A1 | 2/2009 | Shiraishi et al. | |
| 2010/0083942 | A1 | 4/2010 | Lykowski et al. | |
| 2010/0175653 | A1 | 7/2010 | Lykowski et al. | |
| 2010/0212620 | A1 * | 8/2010 | Shimizu | 123/143 B |

* cited by examiner

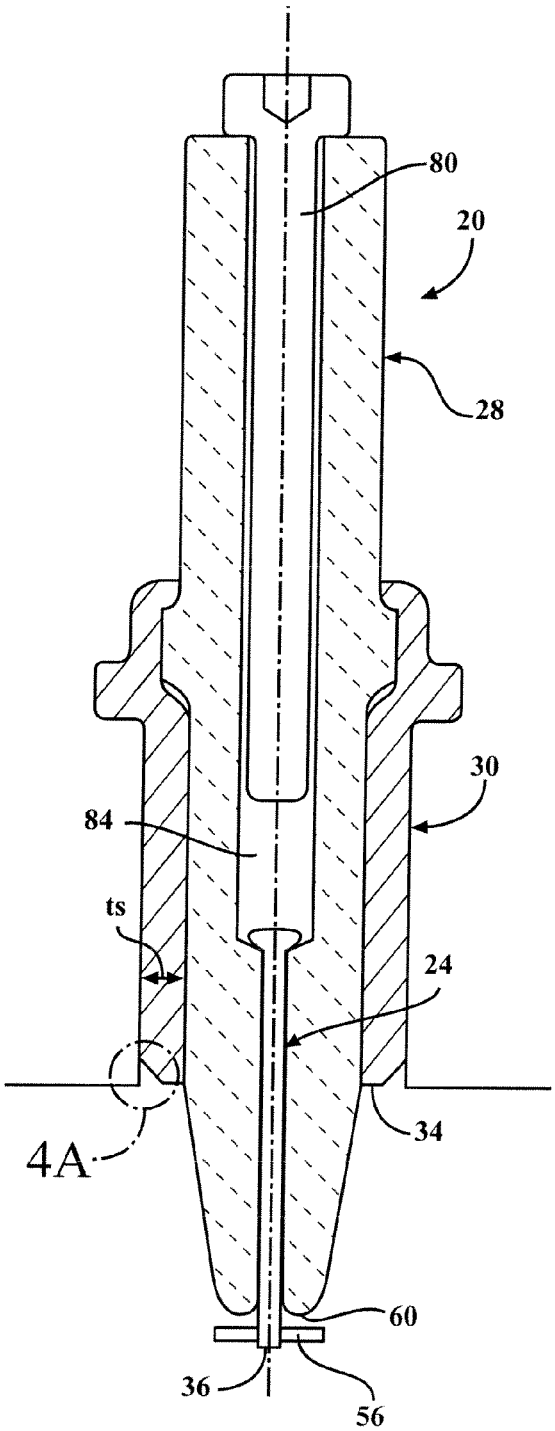
FIG. 4
FIG. 4A
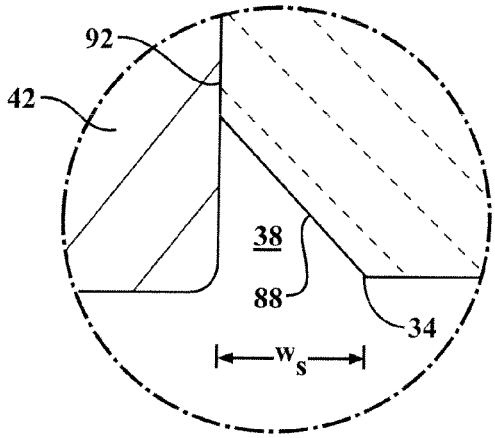

CORONA IGNITER HAVING CONTROLLED LOCATION OF CORONA FORMATION

CROSS REFERENCE TO RELATED APPLICATIONS

This application claims the benefit of U.S. provisional application Ser. No. 61/432,364, filed Jan. 13, 2011, and U.S. provisional application Ser. No. 61/432,520, filed Jan. 14, 2011, the entire contents of which are incorporated herein by reference in their entirety.

BACKGROUND OF THE INVENTION

1. Field of the Invention

This invention relates generally to a corona igniter for emitting a radio frequency electric field to ionize a fuel-air mixture and provide a corona discharge, and a method of forming the corona igniter.

2. Related Art

Corona discharge ignition systems provide an alternating voltage and current, reversing high and low potential electrodes in rapid succession which makes arc formation difficult and enhances the formation of corona discharge. The system includes a corona igniter with a central electrode charged to a high radio frequency voltage potential and creating a strong radio frequency electric field in a combustion chamber. The electric field causes a portion of a mixture of fuel and air in the combustion chamber to ionize and begin dielectric breakdown, facilitating combustion of the fuel-air mixture. The electric field is controlled so that the fuel-air mixture maintains dielectric properties and corona discharge occurs at the electrode firing end, also referred to as a non-thermal plasma. The ionized portion of the fuel-air mixture forms a flame front which then becomes self-sustaining and combusts the remaining portion of the fuel-air mixture. Preferably, the electric field is concentrated at the electrode firing end and controlled so that the fuel-air mixture does not lose all dielectric properties, which would create a thermal plasma and an electric arc between the electrode and grounded cylinder walls, piston, or other portion of the igniter. An example of a corona discharge ignition system is disclosed in U.S. Pat. No. 6,883,507 to Freen.

The central electrode of the corona igniter is formed of an electrically conductive material and receives the high radio frequency voltage and emits the radio frequency electric field into the combustion chamber to ionize the fuel-air mixture and provide the corona discharge. An insulator formed of an electrically insulating material surrounds the central electrode and is received in a metal shell. The igniter of the corona discharge ignition system does not include any grounded electrode element intentionally placed in close proximity to a firing end of the central electrode. Rather, the ground is preferably provided by cylinder walls or a piston of the ignition system. An example of a corona igniter is disclosed in U.S. Patent Application Publication No. 2010/0083942 to Lykowski and Hampton.

During use of the corona igniter, when energy is supplied to the central electrode, the electrical potential and the voltage can drop significantly between the central electrode and the metal shell due to the low relative permittivity of air between those components. The high voltage drop and a corresponding spike in electric field strength tends to ionize the air between the central electrode and the shell, leading to significant energy loss at the electrode firing end. In addition, the ionized air adjacent the shell is prone to migrating toward the electrode firing end, or vice versa, forming a conductive path across the insulator between the central electrode and the shell, and reducing the effectiveness of the corona discharge at the electrode firing end. The conductive path between the central electrode and shell may lead to arc discharge between those components, which is oftentimes undesired and reduces the quality of ignition at the electrode firing end.

SUMMARY OF THE INVENTION

One aspect of the invention includes an igniter for providing a corona discharge. The igniter includes a central electrode formed of an electrically conductive material for receiving a high radio frequency voltage and emitting a radio frequency electric field to ionize a fuel-air mixture and provide the corona discharge. The insulator is formed of an electrically insulating material and is disposed around the central electrode. The insulator extends longitudinally from an insulator upper end to an insulator nose end. The insulator also presents an insulator inner surface facing the electrode and an oppositely facing insulator outer surface extending between the insulator upper end and the insulator nose end. A shell formed of an electrically conductive metal material is disposed around the insulator and extends longitudinally from a shell upper end toward the insulator nose end to a shell lower end. The shell presents a shell inner surface facing the insulator outer surface and an oppositely facing shell outer surface extending between the shell lower end and the shell upper end. The shell presents a shell gap having a shell gap width between the shell lower end and at least one of the shell inner surface and the shell outer surface. The shell gap is open at the shell lower end allowing air to flow therein, and the shell gap width increases toward the shell lower end.

Another aspect of the invention provides a corona discharge ignition system for providing a radio frequency electric field to ionize a portion of a combustible fuel-air mixture and provide a corona discharge in a combustion chamber of an internal combustion engine, and the systems includes the corona igniter.

Yet another aspect of the invention provides a method of forming the corona igniter. The method comprises the steps of providing a central electrode formed of an electrically conductive material and providing an insulator formed of an electrically insulating material and including an insulator inner surface extending longitudinally from an insulator upper end toward an insulator nose end. The method next includes inserting the central electrode into the insulator along the insulator inner surface. The method includes providing a shell formed of an electrically conductive material including a shell outer surface and a shell inner surface extending longitudinally from a shell upper end to a shell lower end and having a shell thickness between the shell inner surface and the shell outer surface decreasing toward the shell lower end, and inserting the insulator into the shell along the shell inner surface.

The increasing shell gap width controls the location of the corona discharge and enhances the corona discharge between the central electrode and the shell. Thus, the corona igniter is able to provide a more controlled, concentrated corona discharge and a more robust ignition, compared to other corona igniters.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 4 is a cross-sectional view of a corona igniter disposed in a combustion chamber according to another embodiment of the invention;

FIG. 4A is an enlarged view showing the shell lower end of FIG. 4.

DETAILED DESCRIPTION OF THE ENABLING EMBODIMENTS

Figure 1:
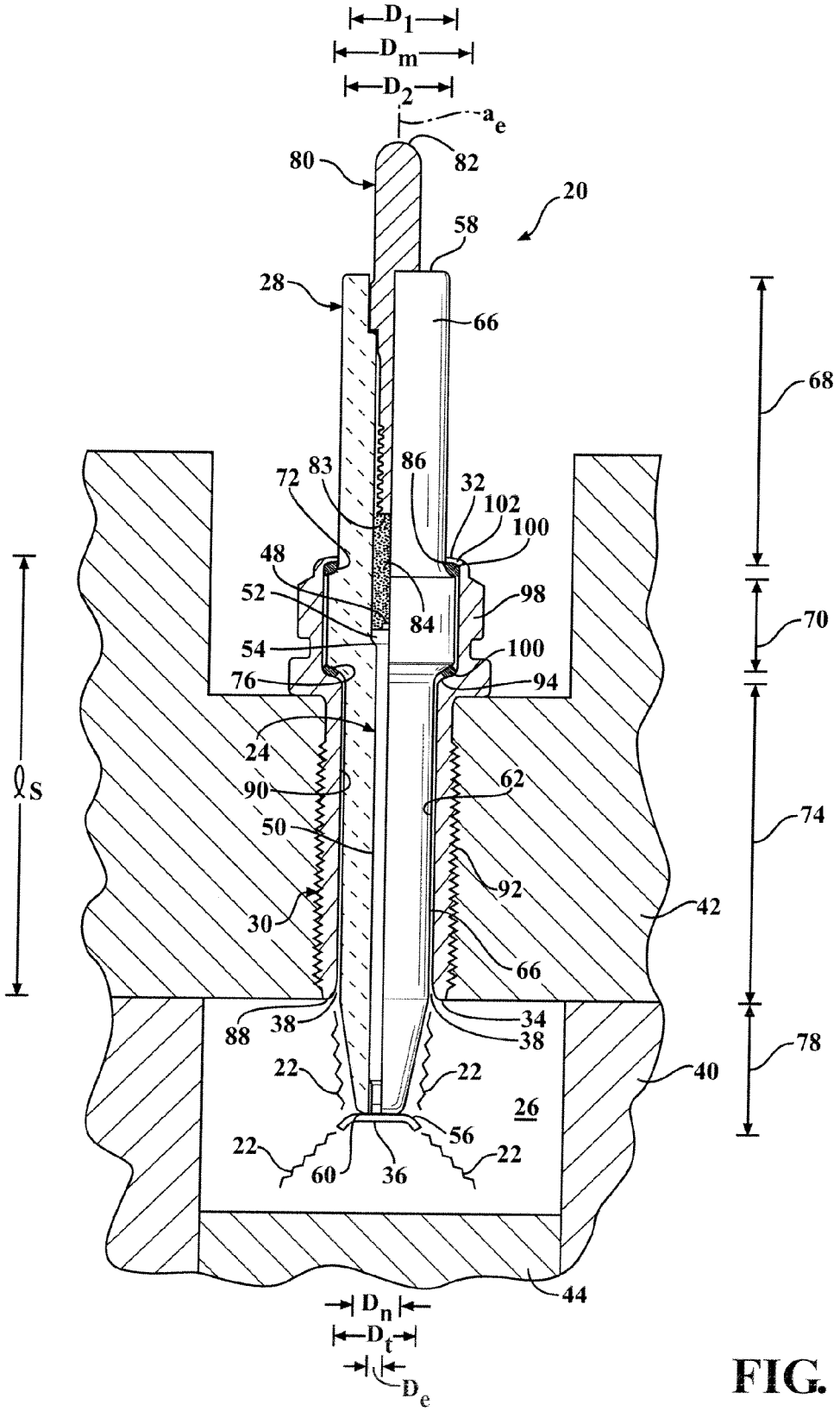
FIG. 1 is a cross-sectional view of a corona igniter disposed in a combustion chamber according to one embodiment of the invention.

One aspect of the invention provides a corona igniter 20 for a corona discharge ignition system. The system intentionally creates an electrical source which suppresses the formation of an arc and promotes the creation of strong electrical fields which produce corona discharge 22. The ignition event of the corona discharge ignition system includes multiple electrical discharges running at approximately 1 megahertz.

The igniter 20 of the system includes a central electrode 24 for receiving energy at a high radio frequency voltage and including an electrode firing end 36 emitting a radio frequency electric field to ionize a portion of a combustible fuel-air mixture and provide a corona discharge 22 in a combustion chamber 26 of an internal combustion engine. The central electrode 24 is inserted into an insulator 28 and a metal shell 30 is disposed around the insulator 28. The shell 30 extends from a shell upper end 32 to a shell lower end 34 such that the insulator 28 and the electrode firing end 36 project outwardly of the shell lower end 34. The shell 30 also has a shell thickness $t_s$ decreasing toward the shell lower end 34 which provides a shell gap 38 having a shell gap width $w_s$ increasing toward the shell lower end 34 and open at the shell lower end 34 allowing air to flow therein.

Figure 2:
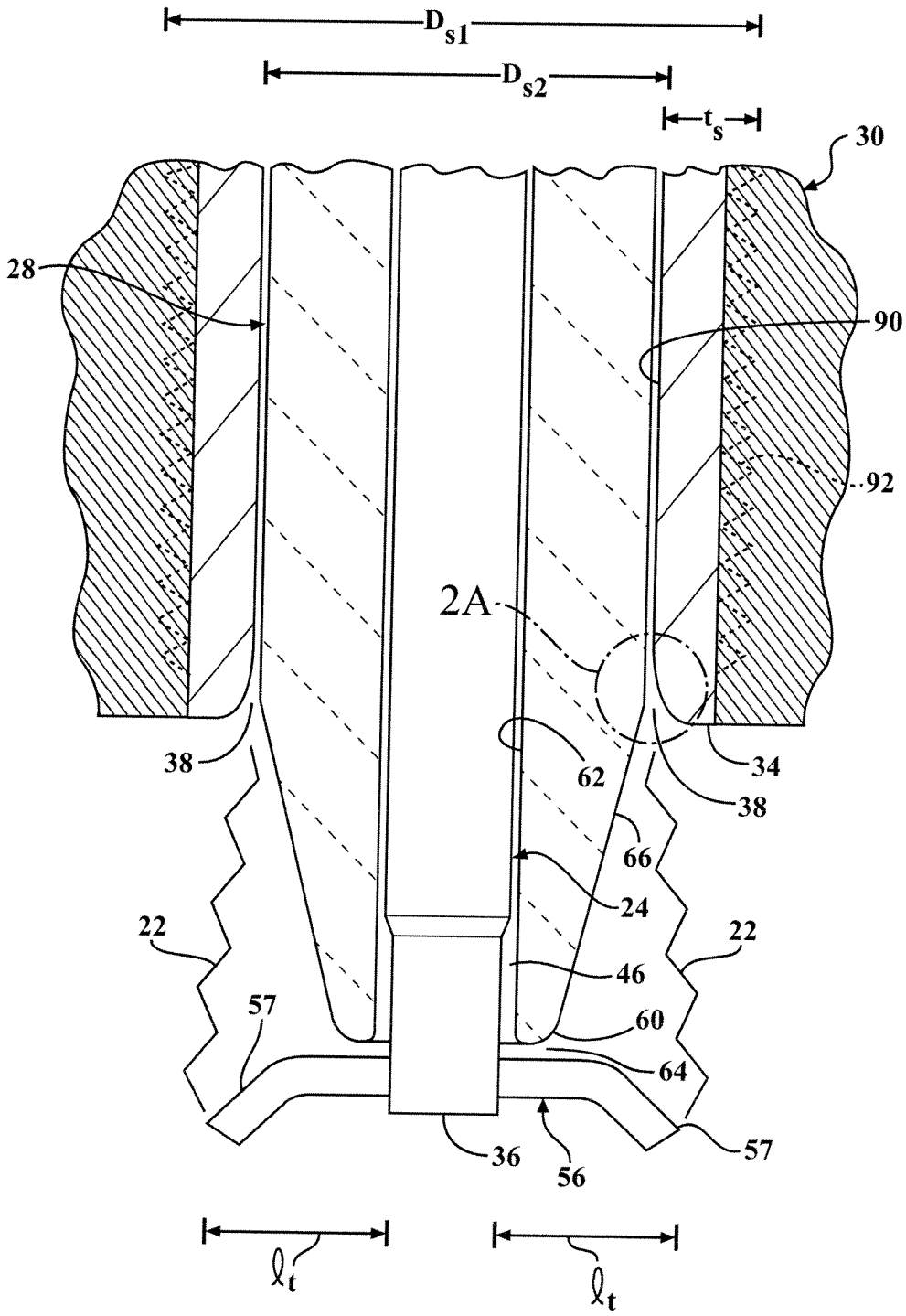
FIG. 2 is an enlarged view showing a shell lower end and an insulator nose region according to one embodiment of the invention.

The increasing shell gap width $w_s$ helps control the location of the corona discharge 22 and enhances the corona discharge 22 between the central electrode 24 and the shell 30. In one embodiment, the corona igniter 20 provides the corona discharge 22 between the central electrode 24 and the shell 30, and also at the electrode firing end 36, as shown in FIG. 1. In another embodiment, the corona igniter 20 provides the corona discharge 22 only between the central electrode 24 and the shell 30, as shown in FIG. 2.

In certain embodiments, the increasing shell gap 38 may also encourage any corona formation between the shell 30 and insulator 28 to migrate out of the shell gap 38. In certain embodiments, the design of the corona igniter 20 may also reduce arc discharge between the central electrode 24 and the shell 30. For example, the increasing shell gap width $w_s$ may create a greater distance between the central electrode 24 and grounded shell 30 and thus increase the amount of time it takes to form a conductive path causing the unwanted arc discharge between the central electrode 24 and shell 30.

The corona igniter 20 is typically used in an internal combustion engine of an automotive vehicle or industrial machine. As shown in FIG. 1, the engine typically includes a cylinder block 40 having a side wall extending circumferentially around a cylinder center axis and presenting a space therebetween. The side wall of the cylinder block 40 has a top end surrounding a top opening, and a cylinder head 42 is disposed on the top end and extends across the top opening. A piston 44 is disposed in the space along the side wall of the cylinder block 40 for sliding along the side wall during operation of the internal combustion engine. The piston 44 is spaced from the cylinder head 42 such that the cylinder block 40 and the cylinder head 42 and the piston 44 provide the combustion chamber 26 therebetween. The combustion chamber 26 contains the combustible fuel-air mixture ionized by the corona igniter 20. The cylinder head 42 includes an access port receiving the igniter 20, and the igniter 20 extends transversely into the combustion chamber 26 such that the shell gap 38 is exposed to the fuel-air mixture of the combustion chamber 26. The igniter 20 receives a high radio frequency voltage from a power source (not shown) and emits the radio frequency electric field to ionize a portion of the fuel-air mixture and form the corona discharge 22.

The central electrode 24 of the igniter 20 extends longitudinally along an electrode center axis $a_e$ from an electrode terminal end 48 to the electrode firing end 36. Energy at the high radio frequency AC voltage is applied to the central electrode 24 and the electrode terminal end 48 receives the energy at the high radio frequency AC voltage, typically a voltage up to 40,000 volts, a current below 1 ampere, and a frequency of 0.5 to 5.0 megahertz. The electrode 24 includes an electrode body portion 50 formed of an electrically conductive material, such as nickel. In one embodiment, the material of the electrode 24 has a low electrical resistivity of below 1,200 nΩ·m. The electrode body portion 50 presents an electrode diameter $D_e$ being perpendicular to the electrode center axis $a_e$. The electrode body portion 50 includes a head 52 at the electrode terminal end 48 which has an electrode diameter $D_e$ greater than the electrode diameter $D_e$ along the remaining sections of the electrode body portion 50.

Figure 3:
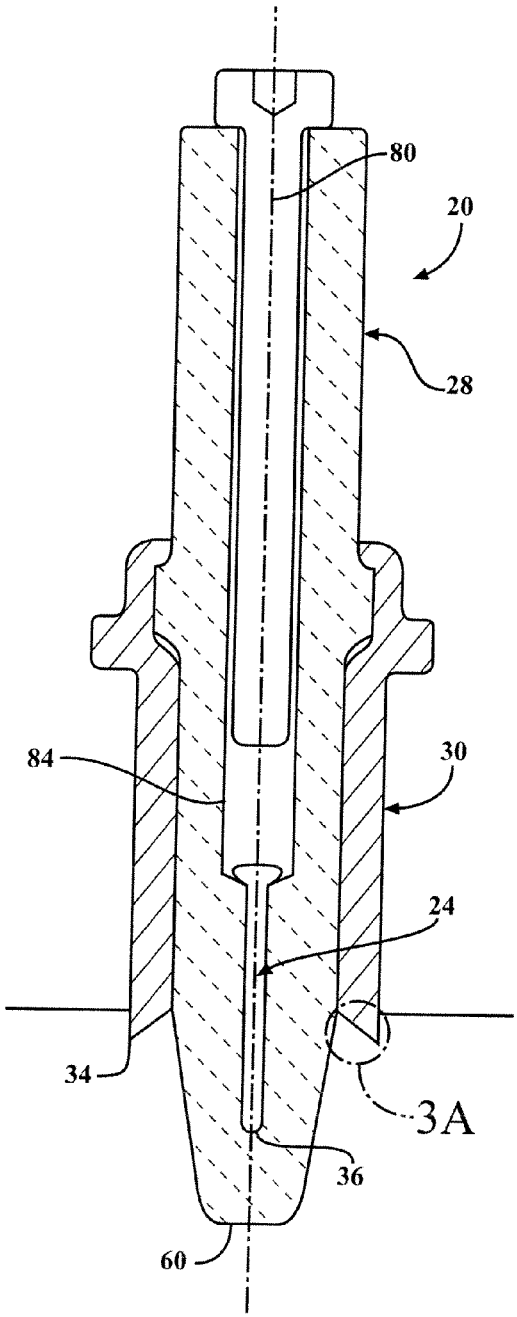
FIG. 3 is a cross-sectional view of a corona igniter disposed in a combustion chamber according to another embodiment of the invention.

The central electrode 24 is inserted into the insulator 28 such that the head 52 of the central electrode 24 rests on an electrode seat 54 along a bore of the insulator 28. In one embodiment, the clearance required to insert the electrode 24 into the insulator 28 provides an electrode gap 46 between the electrode 24 and the insulator 28, allowing air to flow between the electrode 24 and insulator 28. Alternatively, there is no gap between the electrode 24 and insulator 28. According to one embodiment, as shown in FIGS. 1, 2, and 4, the bore of the insulator 28 extends continuously through the insulator 28 such that the electrode firing end 36 is disposed outward of the insulator 28. According to another embodiment, as shown in FIG. 3, the electrode firing end 36 is encased by the insulator 28.

When the electrode firing end 36 is disposed outward of the insulator 28, the central electrode 24 typically includes a firing tip 56 surrounding and adjacent the electrode firing end 36 for emitting the radio frequency electric field to ionize a portion of the fuel-air mixture and provide the corona discharge 22 in the combustion chamber 26. The firing tip 56 is formed of an electrically conductive material providing exceptional thermal performance at high temperatures, for example a material including at least one element selected from Groups 4-12 of the Periodic Table of the Elements. As shown in FIG. 1, the firing tip 56 presents a tip diameter $D_t$ that is greater than the electrode diameter $D_e$ of the electrode body portion 50. The firing tip 56 typically includes a plurality of prongs 57, and each prong 57 presents a tip length $l_t$ extending outward from the electrode center axis $a_e$, as shown in FIG. 2.

The insulator 28 of the corona igniter 20 is disposed annularly around and longitudinally along the electrode body portion 50. The insulator 28 extends longitudinally from an insulator upper end 58 past the electrode terminal end 48 an insulator nose end 60. FIG. 2 is an enlarged view showing the insulator nose end 60 according to one embodiment of the invention, wherein the insulator nose end 60 is spaced from the electrode firing end 36 and the firing tip 56 of the electrode 24. The insulator nose end 60 and the firing tip 56 present a tip space 64 therebetween allowing ambient air to flow between the insulator nose end 60 and the firing tip 56. According to another embodiment (not shown), the firing tip 56 abuts the insulator 28 so that there is no space therebetween.

The insulator 28 is formed of an electrically insulating material, typically a ceramic material including alumina. The insulator 28 has an electrical conductivity less than the electrical conductivity of the central electrode 24 and the shell 30. In one embodiment, the insulator 28 has a dielectric strength of 14 to 25 kV/mm. The insulator 28 also has a relative permittivity capable of holding an electrical charge, typically a relative permittivity of 6 to 12. In one embodiment, the insulator 28 has a coefficient of thermal expansion (CTE) between $2\times10^{-6}$/° C. and $10\times10^{-6}$/° C.

The insulator 28 includes an insulator inner surface 62 facing the electrode 24 surface of the electrode body portion 50 and extending longitudinally along the electrode center axis $a_e$ between the insulator upper end 58 and the insulator nose end 60. The insulator inner surface 62 presents an insulator bore receiving the central electrode 24 and includes the electrode seat 54 for supporting the head 52 of the central electrode 24.

In one embodiment, the insulator bore extends continuously from the insulator upper end 58 to the insulator nose end 60 and the electrode firing tip 56 is disposed outwardly of the insulator nose end 60, as shown in FIGS. 1, 2, and 4. In another embodiment, the insulator nose end 60 is closed and encases the electrode firing end 36, as shown in FIG. 3.

The igniter 20 is typically formed by inserting the electrode firing end 36 through the insulator upper end 58 and into the insulator bore until the head 52 of the central electrode 24 rests on the electrode seat 54. The remaining portions of the electrode body portion 50 below the head 52 are typically spaced from the insulator inner surface 62 to provide the electrode gap 46 therebetween.

The insulator 28 of the corona igniter 20 includes an insulator outer surface 66 opposite the insulator inner surface 62 and extending longitudinally along the electrode center axis $a_e$ from the insulator upper end 58 to the insulator nose end 60. The insulator outer surface 66 faces opposite the insulator inner surface 62, outwardly toward the shell 30, and away from the central electrode 24. In one preferred embodiment, the insulator 28 is designed to fit securely in the shell 30 and allow for an efficient manufacturing process.

As shown in FIGS. 1, 3, and 4 the insulator 28 includes an insulator first region 68 extending along the electrode body portion 50 from the insulator upper end 58 toward the insulator nose end 60. The insulator first region 68 presents an insulator first diameter $D_1$ extending generally perpendicular to the electrode center axis $a_e$. The insulator 28 also includes an insulator middle region 70 adjacent the insulator first region 68 extending toward the insulator nose end 60. The insulator middle region 70 also presents an insulator middle diameter $D_m$ extending generally perpendicular to the electrode center axis $a_e$, and the insulator middle diameter $D_m$ is greater than the insulator first diameter $D_1$. An insulator upper shoulder 72 extends radially outwardly from the insulator first region 68 to the insulator middle region 70.

The insulator 28 also includes an insulator second region 74 adjacent the insulator middle region 70 extending toward the insulator nose end 60. The insulator second region 74 presents an insulator second diameter $D_2$ extending generally perpendicular to the electrode center axis $a_e$, which is less than the insulator middle diameter $D_m$. An insulator lower shoulder 76 extends radially inwardly from the insulator middle region 70 to the insulator second region 74.

The insulator 28 further includes an insulator nose region 78 extending from the insulator second region 74 to the insulator nose end 60. The insulator nose region 78 presents an insulator nose diameter $D_n$ extending generally perpendicular to the electrode center axis $a_e$ and preferably tapering or decreasing to the insulator nose end 60. The insulator nose diameter $D_n$ at the insulator nose end 60 is less than the insulator second diameter $D_2$ and less than the tip diameter $D_t$ of the firing tip 56.

As shown in FIG. 1, the corona igniter 20 includes a terminal 80 formed of an electrically conductive material received in the insulator 28. The terminal 80 includes a first terminal end 82 electrically connected to a terminal wire (not shown), which is electrically connected to the power source (not shown). The terminal 80 also includes a second terminal end 83 which is in electrical communication with the electrode terminal end 48. Thus, the terminal 80 receives the high radio frequency voltage from the power source and transmits the high radio frequency voltage to the electrode 24. A conductive seal layer 84 formed of an electrically conductive material is disposed between and electrically connects the terminal 80 and the electrode 24 so that the energy can be transmitted from the terminal 80 to the electrode 24.

The shell 30 of the corona igniter 20 is disposed annularly around the insulator 28. The shell 30 is formed of an electrically conductive metal material, such as steel. In one embodiment, the shell 30 has a low electrical resistivity below 1,000 mΩ·m. As shown in FIGS. 1, 3, and 4, the shell 30 extends longitudinally along the insulator 28 from the shell upper end 32 to the shell lower end 34. The shell lower end 34 is the location of the shell 30 closest to the electrode firing end 36.

The shell 30 includes a shell upper surface 86 at the shell upper end 32 and a shell lower surface 88 at the shell lower end 34. The shell 30 includes a shell inner surface 90 facing the insulator outer surface 66 and an oppositely facing shell outer surface 92 each extending longitudinally and continuously from the shell upper surface 86 at the shell upper end 32 to the shell lower surface 88 at the shell lower end 34. The shell thickness $t_s$ extends from the shell inner surface 90 to the shell outer surface 92. The shell outer surface 92 presents a perimeter extending circumferentially around the insulator 28, and an outer shell diameter $D_{s1}$ extends across the perimeter. The outer shell diameter $D_{s1}$ is preferably at least 1.5 times greater than the tip length $l_t$ of the firing tip 56 to increase the amount of time it takes for a conductive path to form between the central electrode 24 and the shell 30, compared to the amount of time it would take with a lower outer shell diameter $D_{s1}$. In one embodiment, the outer shell diameter $D_{s1}$ is 12 to 18 mm.

The shell inner surface 90 extends along the insulator first region 68 along the insulator upper shoulder 72 and the insulator middle region 70 and the insulator lower shoulder 76 and the insulator second region 74 to the shell lower end 34 adjacent the insulator nose region 78. The shell inner surface 90 presents a shell bore receiving the insulator 28. The shell inner surface 90 also presents an inner shell diameter $D_{s2}$ extending across the shell bore. The inner shell diameter $D_{s2}$ is greater than the insulator nose diameter $D_n$ such that the insulator 28 can be inserted into the shell bore and at least a portion of the insulator nose region 78 projects outwardly of the shell lower end 34. The shell inner surface 90 presents a shell seat 94 for supporting the insulator lower shoulder 76. In the embodiment of FIG. 1, the shell seat 94 is disposed adjacent a tool receiving member 98.

The shell inner surface 90 is typically spaced from the insulator outer surface 66 continuously from the shell upper end 32 to the shell lower end 34 to provide the shell gap 38 therebetween, as shown in FIGS. 1, 2, 3 and 3A. In another embodiment, the shell inner surface 90 is disposed tightly against the insulator 28 and the shell gap 38 is only located along the shell lower surface 88 between the shell inner surface 90 and the shell lower end 34, as shown in FIGS. 3B, 4, and 4B. In another embodiment, as shown in FIGS. 4 and 4A, the shell gap 38 is disposed between the shell 30 and the cylinder block 40.

The shell gap 38 is located between the shell lower end 34 and one of the shell inner surface 90 and the shell outer surface 92, for example between the shell lower end 34 and the shell inner surface 90 or between the shell lower end 34 and the shell outer surface 92. The shell gap 38 has a shell gap width $w_s$ increasing gradually between the shell inner surface 90 or shell outer surface 92 and the shell lower end 34, for example from the shell inner surface 90 along the shell lower surface 88 to the shell lower end 34. As shown in the Figures, the shell thickness $t_s$ decreases toward the shell lower end 34 such that the shell gap width $w_s$ is greatest at the shell lower end 34. The shell gap 38 is open at the shell lower end 34 such that air from the surrounding environment can flow therein. In preferred embodiments, such as the embodiments of FIGS. 3 and 4, the shell 30 has a shell length $l_s$ between the said shell upper end 32 and the shell lower end 34, and the increasing shell gap width $w_s$ extends along 0.1 to 10% of the shell length $l_s$.

The increasing shell gap width $w_s$ encourages any corona discharge 22 that may form between the shell 30 and insulator 28 to migrate out of the shell gap 38. The increasing shell gap width $w_s$ also creates a greater distance between the central electrode 24 and the grounded shell 30 and thus increases the amount of time it takes to form a conductive path between the central electrode 24 and the shell 30, compared to smaller shell gaps. Accordingly, the increasing shell gap width $w_s$ helps concentrate the corona discharge 22 at the electrode firing end 46 and prevents unwanted arc discharge between the central electrode 24 and the shell 30.

Figure 2A:
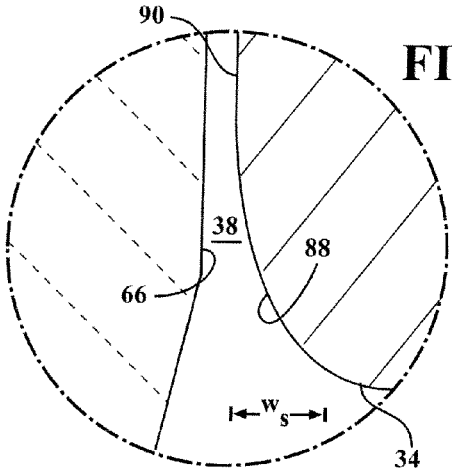
FIG. 2A is an enlarged view showing the shell gap of FIG. 2.
Figure 2B:
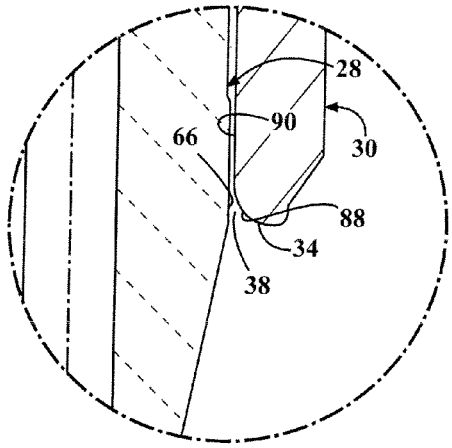
FIGS. 2B-2E is are enlarged views showing a shell gap according to other embodiments of the invention.

In the embodiment of FIGS. 1 and 2, the shell gap 38 extends continuously between the shell upper end 32 and the shell lower end 34. The shell inner surface 90 transitions smoothly to the shell lower surface 88, and the shell lower surface 88 presents a convex profile facing the insulator outer surface 66, as best shown in FIGS. 2A and 2B. The convex profile of the shell lower surface 88 presents the gradually increasing shell gap width $w_s$. In this embodiment, the shell lower surface 88 presents a spherical radius greater than 0.010, preferably greater than 0.1 facing the insulator outer surface 66. The spherical radius at a particular point along the shell lower surface 88 is determined using a hypothetical, three-dimensional sphere having a radius at the particular point. The spherical radius is the radius of the three-dimensional sphere. The spherical radius at the shell lower surface 88 is used to present the shell gap 38 and modify the electrical field strength and voltage fields along the shell gap 38 to encourage corona discharge 22 formation between the shell 30 and firing tip 56 and also reduce the formation of hard discharge.

Figure 3A:
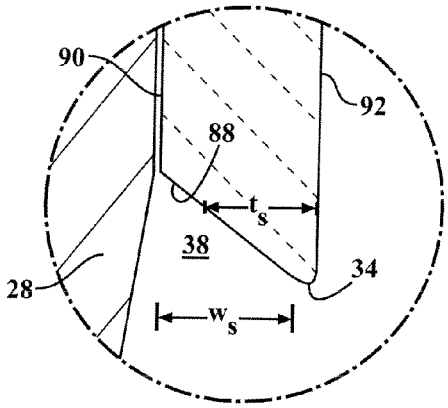
FIG. 3A is an enlarged view showing the shell lower end of FIG. 3.
Figure 3B:
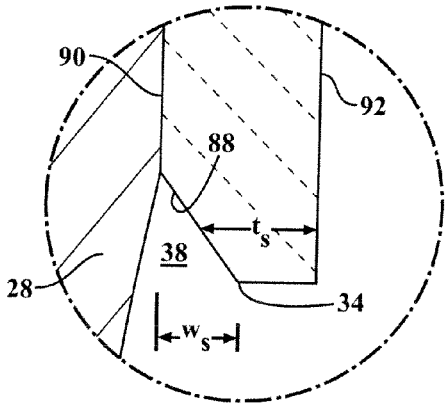
FIG. 3B is an enlarged view showing an alternate shell lower end.

In the embodiment of FIGS. 3 and 3A, the shell gap 38 also extends continuously between the shell upper end 32 and the shell lower end 34. However, in this embodiment, the entire shell lower surface 88 is chamfered, such that the shell lower surface 88 extends continuously from the shell inner surface 90 to the shell outer surface 92 and the shell lower end 34 is disposed at the shell outer surface 92. The chamfered shell lower surface 88 presents the shell gap width $w_s$ increasing gradually from the shell inner surface 90 to the shell lower end 34 at the shell outer surface 92.

Figure 2C:
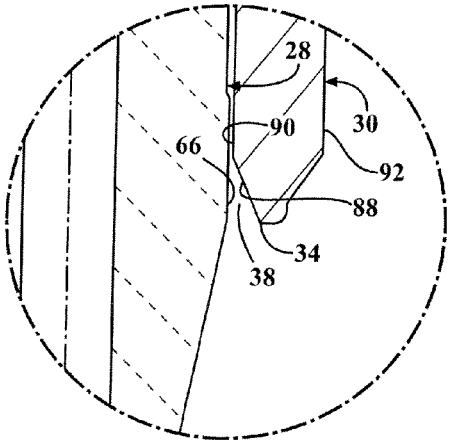

In another embodiment, shown in FIGS. 2C and 4B, only a portion of the shell lower surface 88 is chamfered, such that the shell lower end 34 is disposed along the shell lower surface 88 between the shell inner surface 90 and the shell outer surface 92. In this embodiment, the shell gap width $w_s$ increases gradually from the shell inner surface 90 along a portion of the shell lower surface 88 to the shell lower end 34 and then remains consistent along the shell lower surface 88 to the shell outer surface 92. In the embodiment of FIG. 2C, the chamfer at the shell lower surface 88 is used to present the shell gap 38 and modify the electrical field strength and voltage fields along the shell gap 38 to encourage corona discharge 22 formation between the shell 30 and firing tip 56 and also reduce the formation of hard discharge.

In the embodiment of FIGS. 4 and 4A, the gradually increasing shell gap width $w_s$ is located between the shell 30 and the cylinder block 40. In this embodiment, the shell outer surface 92 engages the cylinder block 40 and the shell gap 38 is located along the shell lower surface 88 between the shell outer surface 92 and the shell lower end 34. A portion of the shell lower surface 88 is chamfered. The chamfered portion of the shell lower surface 88 presents the shell gap width $w_s$ that increases gradually from the shell outer surface 92 along a portion of the shell lower surface 88 to the shell lower end 34 and then remains consistent along the shell lower surface 88 to the shell inner surface 90.

In one embodiment, an internal seal 100 may be disposed between the shell inner surface 90 and the insulator outer surface 66 to support the insulator 28 once the insulator 28 is inserted into the shell 30. The internal seal 100 spaces the insulator outer surface 66 from the shell inner surface 90 to provide the shell gap 38 therebetween. When the internal seal 100 is employed, the shell gap 38 typically extends continuously from the shell upper end 32 to the shell lower end 34. As shown in FIG. 1, one of the internal seals 100 is typically disposed between the insulator outer surface 66 of the insulator lower shoulder 76 and the shell inner surface 90 of the shell seat 94 adjacent the tool receiving member 98 and another one of the internal seals 100 between the insulator outer surface 66 of the insulator upper shoulder 72 and the shell inner surface 90. The internal seals 100 are positioned to provide support and maintain the insulator 28 in position relative to the shell 30.

In the embodiment of FIGS. 1, 3, and 4, the insulator 28 rests on the internal seal 100 disposed on the shell seat 94 and the remaining sections of the insulator 28 are spaced from the shell inner surface 90, such that the insulator outer surface 66 and the shell inner surface 90 present the shell gap 38 therebetween. The shell gap 38 extends continuously along the insulator outer surface 66 from the insulator upper shoulder 72 to the insulator nose region 78, and also annularly around the insulator 28.

Figure 2D:
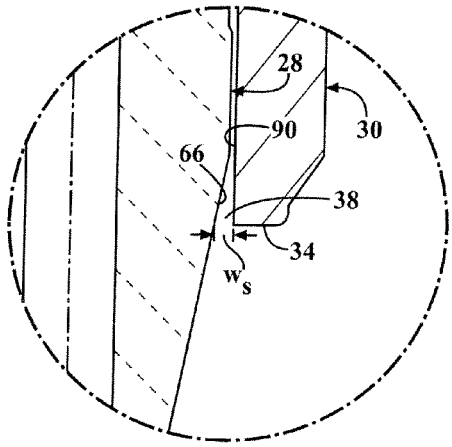

In the embodiment of FIGS. 2D and 3, the shell inner surface 90 and the tapering insulator nose region 78 are used to present the shell gap 38 and modify the electrical field strength and voltage fields along the shell gap 38 to encourage corona discharge 22 formation between the shell 30 and firing tip 56 and also reduce the formation of hard discharge. In one embodiment, the increasing shell gap 38 is provided by the tapering insulator 38 alone, and not the shell 38. In this embodiment, the shell length $l_s$ may be longer than in other embodiments.

Figure 2E:
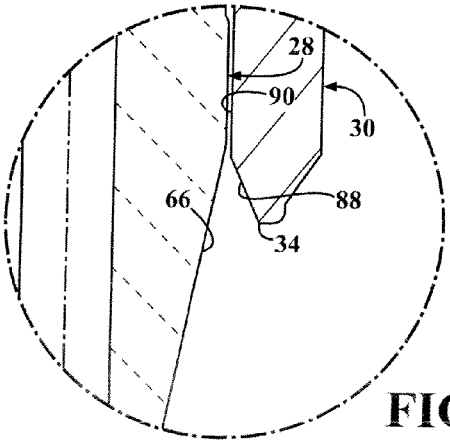

In the embodiment of FIG. 2E, the chamfer at the shell lower surface 88 and the tapering insulator nose region 78 are used to present the shell gap 38 and modify the electrical field strength and voltage fields along the shell gap 38 to encourage corona discharge 22 formation between the shell 30 and firing tip 56 and also reduce the formation of hard discharge.

The shell 30 typically includes the tool receiving member 98, which can be employed by a manufacturer or end user to install and remove the corona igniter 20 from the cylinder head 42. The tool receiving member 98 extends along the insulator middle region 70 from the insulator upper shoulder 72 to the insulator lower shoulder 76. In one embodiment, the shell 30 also includes threads along the insulator second region 74 for engaging the cylinder head 42 and maintaining the corona igniter 20 in a desired position relative to the cylinder head 42 and the combustion chamber 26.

The shell 30 also typically includes a turnover lip 102 extending longitudinally from the tool receiving member 98 along the insulator outer surface 66 of the insulator middle region 70, and then and inwardly along the insulator upper shoulder 72 to the insulator first region 68. The turnover lip 102 extends annularly around the insulator upper shoulder 72 so that the insulator first region 68 projects outwardly of the turnover lip 102. The shell upper surface 86 is turned inwardly toward the insulator 28 and at least a portion of the shell upper surface 86 engages the insulator middle region 70 and helps fix the shell 30 against axial movement relative to the insulator 28.

Figure 5:
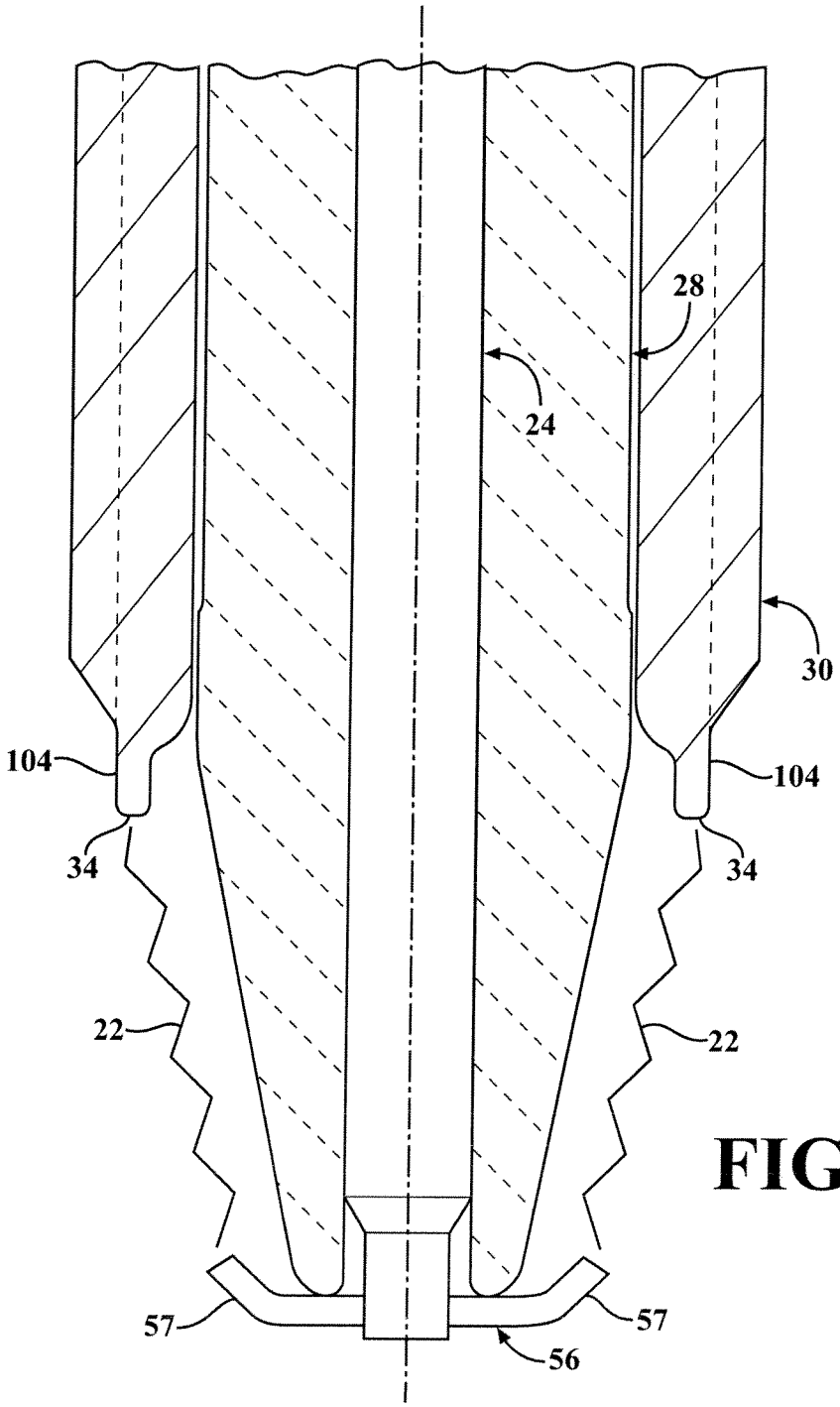
FIG. 5 is an enlarged view a showing a shell lower end and an insulator nose region according to another embodiment of the invention.

In an another embodiment, shown in FIG. 5, the shell 30 includes protrusions 104 at the shell lower end 34, and the shell gap 38 is located between the protrusions 104 and the insulator 28. The prongs 57 of the firing tip 56 extend upwardly toward the shell 30 and are aligned with the protrusion 104. The shape of the shell gap 38, firing tip 56 configuration, and aligned protrusions 104 of the shell 30 encourage formation of corona discharge 22 between the shell 30 and the firing tip 56.

Figure 6:
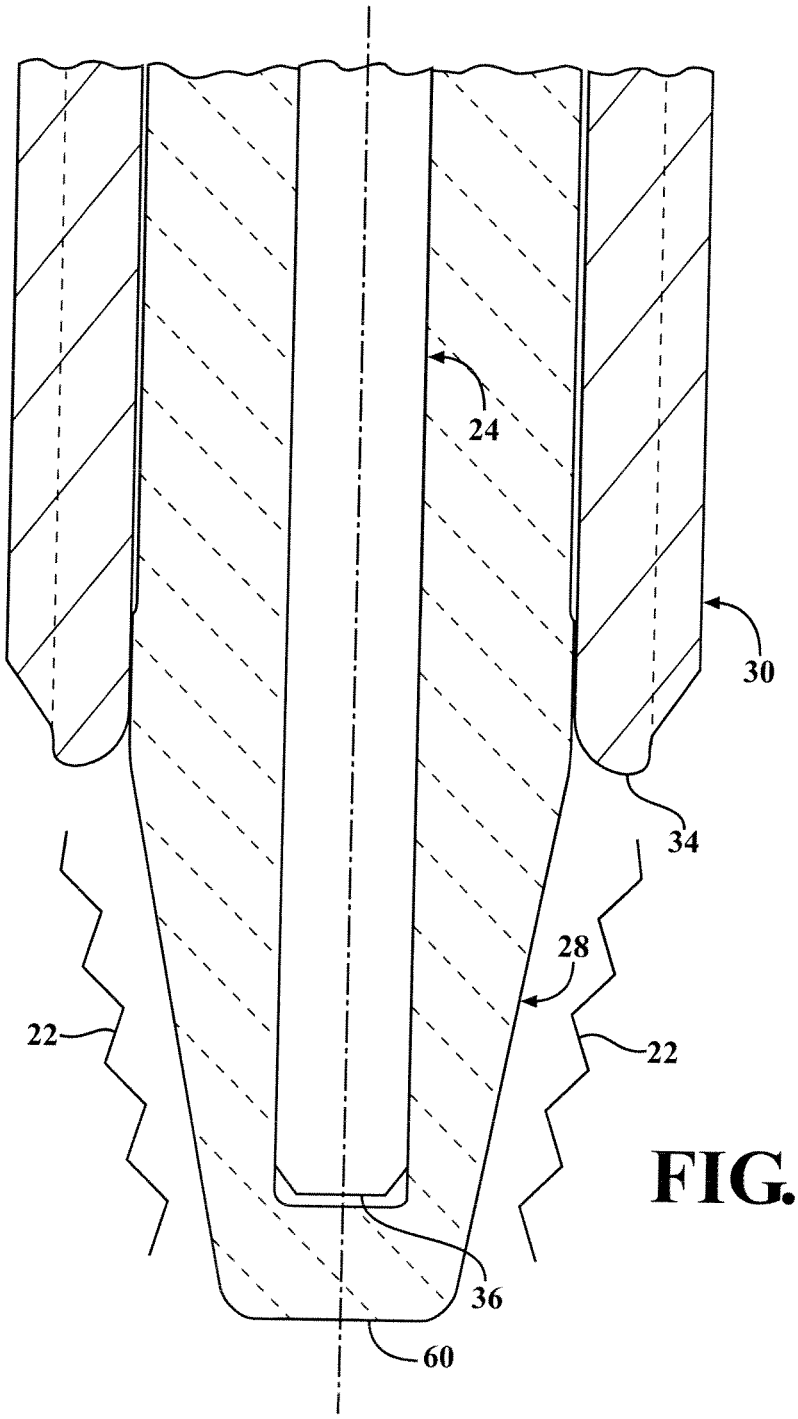
FIG. 6 is an enlarged view a showing a shell lower end and an insulator nose region according to another embodiment of the invention.

In yet another embodiment, shown in FIG. 6, the central electrode 24 is encased by the insulator 28, and the shell lower surface 88 includes a spherical radius. In this embodiment, closing the insulator nose end 60 encourages corona discharge 22 formation from the lower shell end 34 and eliminates the possibility of hard discharge while still using the high voltage on the central electrode 24 to shape streamers of the corona discharge 22.

Another aspect of the invention provides a method of forming the corona igniter 20. The method first includes providing the central electrode 24, the insulator 28, and the shell 30. The insulator 28 is typically formed by molding the ceramic material to include a bore extending continuously through the insulator 28 from the insulator upper end 58 to the insulator nose end 60, or partially through the insulator 28 so that the bore is spaced from the insulator nose end 60. The shell 30 is typically formed by molding or casting and so that the shell thickness $t_s$ decreases toward the shell lower end 34. In one embodiment, the method includes shaping the shell lower surface 88 to provide the decreasing shell thickness $t_s$. In another embodiment, the method includes chamfering the shell lower surface 88 to provide the decreasing shell thickness $t_s$.

Next, the method includes inserting the electrode 24 into the insulator bore along the insulator inner surface 62, and inserting the insulator 28 into the shell bore along the shell inner surface 90. In one embodiment, the method includes disposing the internal seal 100 on the shell seat 94 in the shell bore, and disposing the insulator 28 on the internal seal 100 to provide the shell gap 38. The shell 30 is typically bent around the insulator 28 to fix the shell 30 in position relative to the insulator 28. The shell upper surface 86 may be moved inwardly to engage the insulator 28.

During operation of the corona igniter 20, high electric fields occur in the shell gap 38, including a significant electric field in a region at the opening of the shell gap 38 toward the central electrode 24. In this region, lines of equipotential are angled to an insulator outer surface 66, such that the potential rises moving along the insulator outer surface 66 from the insulator 28 to the shell 30. Positive ions created by the high electrode field migrate to the negatively polarized shell 30, moving towards lower voltages. However, negatively charged ions now migrate toward the insulator outer surface 66, moving towards higher voltages, and then urged away from the shell 30 and towards the central electrode 24, moving always toward higher voltages. Hence, the design of the corona igniter 20 favors the formation of corona discharge 22, or in certain embodiments arc discharge, over the insulator outer surface 66 between the shell 30 and central electrode 24.

Obviously, many modifications and variations of the present invention are possible in light of the above teachings and may be practiced otherwise than as specifically described while within the scope of the appended claims.

ELEMENT LIST

| Element Symbol | Element Name |
|---|---|
| 20 | igniter |
| 22 | corona discharge |
| 24 | electrode |
| 26 | combustion chamber |
| 28 | insulator |
| 30 | shell |
| 32 | shell upper end |
| 34 | shell lower end |
| 36 | electrode firing end |
| 38 | shell gap |
| 40 | cylinder block |
| 42 | cylinder head |
| 44 | piston |
| 46 | electrode gap |
| 48 | electrode terminal end |
| 50 | electrode body portion |
| 52 | head |
| 54 | electrode seat |
| 56 | firing tip |
| 57 | prong |
| 58 | insulator upper end |
| 60 | insulator nose end |
| 62 | insulator inner surface |
| 64 | tip space |
| 66 | insulator outer surface |
| 68 | insulator first region |
| 70 | insulator middle region |
| 72 | insulator upper shoulder |
| 74 | insulator second region |

-continued

| Element Symbol | Element Name |
|---|---|
| 76 | insulator lower shoulder |
| 78 | insulator nose region |
| 80 | terminal |
| 82 | first terminal end |
| 83 | second terminal end |
| 84 | conductive seal layer |
| 86 | shell upper surface |
| 88 | shell lower surface |
| 90 | shell inner surface |
| 92 | shell outer surface |
| 94 | shell seat |
| 98 | tool receiving member |
| 100 | internal seal |
| 102 | turnover lip |
| 104 | protrusion |
| $a_e$ | electrode center axis |
| $D_1$ | insulator first diameter |
| $D_2$ | insulator second diameter |
| $D_e$ | electrode diameter |
| $D_m$ | insulator middle diameter |
| $D_n$ | insulator nose diameter |
| $D_{s1}$ | outer shell diameter |
| $D_{s2}$ | inner shell diameter |
| $D_t$ | tip diameter |
| $l_s$ | shell length |
| $l_t$ | tip length |
| $t_s$ | shell thickness |
| $w_s$ | shell gap width |

What is claimed is:

1. A corona igniter for providing a corona discharge, comprising:

a central electrode formed of an electrically conductive material extending from an electrode terminal end for receiving a high radio frequency voltage to an electrode firing end for emitting a radio frequency electric field to ionize a fuel-air mixture and provide a corona discharge, said central electrode including a firing tip extending radially outwardly from said electrode firing end to present a tip diameter, an insulator formed of an electrically insulating material disposed around said central electrode and extending longitudinally from an insulator upper end to an insulator nose end, said insulator presenting an insulator outer surface extending between said insulator upper end and said insulator nose end, said insulator presenting an insulator nose diameter at said insulator nose end being less than said tip diameter of said firing tip, a shell formed of an electrically conductive metal material disposed around said insulator and extending longitudinally from a shell upper end toward said insulator nose end to a shell lower end, said shell presenting a shell inner surface facing said insulator outer surface and a shell outer surface extending between said shell lower end and said shell upper end, said shell presenting a shell gap having a shell gap width ($w_s$) between said insulator outer surface and said shell inner surface, said shell gap being open at said shell lower end allowing air to flow therein, and said shell gap width ($w_s$) increasing toward said shell lower end.

2. The igniter of claim 1 wherein said shell gap width ($w_s$) increases from said shell inner surface to said shell lower end.

3. The igniter of claim 1 wherein said shell includes a shell lower surface at said shell lower end extending continuously between said shell inner surface and said shell outer surface and wherein said shell lower surface presents said increasing shell gap width ($w_s$).

4. The igniter of claim 3 wherein said shell lower end is disposed at said shell outer surface and said shell gap width ($w_s$) increases from said shell inner surface along said shell lower surface to said shell outer surface.

5. The igniter of claim 3 wherein said shell lower end is disposed along said shell lower surface between said shell inner surface and said shell outer surface and said shell gap width ($w_s$) increases from said shell inner surface along said shell lower surface to said shell lower end.

6. The igniter of claim 3 wherein at least a portion of said shell lower surface is chamfered.

7. The igniter of claim 3 wherein said shell lower surface presents a convex profile facing said insulator.

8. The igniter of claim 3 wherein said shell lower surface presents a spherical radius greater than 0.010 inches facing said insulator.

9. The igniter of claim 1 wherein said shell gap width ($w_s$) increases gradually.

10. The igniter of claim 1 wherein said shell gap is disposed between said shell and said insulator and extends continuously along said shell between said shell upper end and said shell lower end and said shell gap is greatest at said shell lower end.

11. The igniter of claim 1 wherein said shell has a shell length ($l_s$) between said shell upper end and said shell lower end and said increasing shell gap width ($w_s$) extends along 0.1 to 10% of said shell length ($l_s$).

12. The igniter of claim 1 wherein said shell has a shell thickness ($t_s$) between said shell inner surface and said shell outer surface and said shell thickness ($t_s$) decreases toward said shell lower end.

13. The igniter of claim 1 wherein said shell outer surface presents a perimeter extending circumferentially around said insulator and an outer shell diameter ($D_{s1}$) across said perimeter, and said outer shell diameter ($D_{s1}$) is at least 1.5 times greater than said tip diameter ($D_t$).

14. The igniter of claim 13 wherein said tip diameter ($D_t$) is 4 to 7 mm and said outer shell diameter ($D_{s1}$) is 12 to 18 mm.

15. The igniter of claim 1 wherein said insulator includes an insulator nose region extending outwardly of said shell lower end and said insulator outer surface of said insulator nose region presents said insulator nose diameter ($D_n$) which decreases toward said insulator nose end.

16. A corona igniter for providing a corona discharge, comprising:

a central electrode formed of an electrically conductive material extending from an electrode terminal end for receiving a high radio frequency voltage to an electrode firing end for emitting a radio frequency electric field to ionize a fuel-air mixture and provide a corona discharge, an insulator formed of an electrically insulating material disposed around said central electrode and extending longitudinally from an insulator upper end to an insulator nose end, wherein said insulator encases said electrode firing end, said insulator presenting an insulator outer surface extending between said insulator upper end and said insulator nose end, said insulator presenting an insulator nose diameter at said insulator nose end being less than said tip diameter of said firing tip, a shell formed of an electrically conductive metal material disposed around said insulator and extending longitudinally from a shell upper end toward said insulator nose end to a shell lower end, said shell presenting a shell inner surface facing said insulator outer surface and a shell outer surface extending between said shell lower end and said shell upper end, said shell presenting a shell gap having a shell gap width between said insulator outer surface and said shell inner surface, said shell gap being open at said shell lower end allowing air to flow therein, and said shell gap width increasing toward said shell lower end.

17. A corona discharge ignition system for providing a radio frequency electric field to ionize a portion of a combustible fuel-air mixture and provide a corona discharge in a combustion chamber of an internal combustion engine, comprising:

a cylinder block and a cylinder head and a piston providing a combustion chamber therebetween, a mixture of fuel and air provided in said combustion chamber, an igniter disposed in said cylinder head and extending transversely into said combustion chamber for receiving a high radio frequency voltage and emitting a radio frequency electric field to ionize a portion of the fuel-air mixture and form said corona discharge, said igniter including a central electrode formed of an electrically conductive material extending from an electrode terminal end for receiving the high radio frequency voltage to an electrode firing end for emitting the radio frequency electric field to ionize a fuel-air mixture and provide a corona discharge, an insulator formed of an electrically insulating material disposed around said central electrode and extending longitudinally from an insulator upper end to an insulator nose end, said central electrode including a firing tip extending radially outwardly from said electrode firing end to present a tip diameter, said insulator presenting an insulator inner surface facing said electrode surface and an oppositely facing insulator outer surface extending between said insulator upper end and said insulator nose end, said insulator presenting an insulator nose diameter at said insulator nose end being less than said tip diameter of said firing tip, a shell formed of an electrically conductive metal material disposed around said insulator and extending longitudinally from a shell upper end toward said insulator nose end to a shell lower end, said insulator nose end projecting outwardly of said shell lower end, said shell presenting a shell inner surface facing said insulator outer surface and an oppositely facing shell outer surface extending between said shell lower end and said shell upper end, said shell presenting a shell gap having a shell gap width between said insulator outer surface and said shell inner surface, said shell gap being open at said shell lower end allowing air to flow therein, and said shell gap width ($w_s$) increasing toward said shell lower end.

18. A method of forming a corona igniter, comprising the steps of:

providing a central electrode formed of an electrically conductive material extending from an electrode terminal end to an electrode firing end and including a firing tip extending radially outwardly from the electrode firing end to present a tip diameter, providing an insulator formed of an electrically insulating material and including an insulator inner surface extending longitudinally from an insulator upper end to an insulator nose end and presenting an insulator nose diameter at the insulator nose end being less than the tip diameter of the firing tip, inserting the central electrode into the insulator along the insulator inner surface, providing a shell formed of an electrically conductive material including a shell inner surface extending longitudinally from a shell upper end to a shell lower end, inserting the insulator into the shell along the shell inner surface, and presenting a shell gap having a shell gap width between the insulator and the shell inner surface, wherein the shell gap width increases toward the shell lower end and is open at the shell lower end for allowing air to flow therein.

19. The igniter of claim 1 including an internal seal spacing said insulator outer surface from said shell inner surface, and said shell gap extending continuously from said internal seal to said shell lower end.

20. The method of claim 18 including spacing the insulator outer surface from the shell inner surface with an internal seal such that the shell gap extends continuously from the internal seal to the shell lower end.

* * * * *